US007589681B2

(12) United States Patent
Hung

(10) Patent No.: US 7,589,681 B2
(45) Date of Patent: Sep. 15, 2009

(54) WIRELESS COMMUNICATION APPARATUS

(75) Inventor: Chung-Ting Hung, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 0 days.

(21) Appl. No.: 12/036,283

(22) Filed: Feb. 24, 2008

(65) Prior Publication Data

US 2009/0033568 A1 Feb. 5, 2009

(30) Foreign Application Priority Data

Jul. 30, 2007 (TW) ..... 96127760 A

(51) Int. Cl.
*H01Q 1/24* (2006.01)

(52) U.S. Cl. ..... 343/702; 343/906

(58) Field of Classification Search ..... 343/702, 343/904, 905, 906

See application file for complete search history.

(56) References Cited

U.S. PATENT DOCUMENTS

| | | | | |
|---|---|---|---|---|
| 6,107,971 | A * | 8/2000 | Flegeo | 343/702 |
| 6,373,438 | B1 * | 4/2002 | Hwang | 343/702 |
| 6,995,718 | B2 * | 2/2006 | Fang | 343/702 |
| 7,515,109 | B2 * | 4/2009 | Wei | 343/702 |
| 2002/0030628 | A1 * | 3/2002 | Tsai | 343/702 |
| 2004/0135730 | A1 * | 7/2004 | Yang | 343/702 |
| 2006/0082509 | A1 * | 4/2006 | Lee et al. | 343/702 |

* cited by examiner

*Primary Examiner*—HoangAnh T Le
(74) *Attorney, Agent, or Firm*—Jianq Chyun IP Office

(57) ABSTRACT

A wireless communication apparatus includes a housing, a substrate and an antenna, wherein a first through hole is disposed at an edge of the substrate and the antenna includes a body element. The antenna of the present invention utilizes the body element for receiving/transmitting an electromagnetic signal, and the body element of the antenna passes through the first through hole and is fastened to the housing so as to make the substrate fixed in the housing.

12 Claims, 4 Drawing Sheets

WIRELESS COMMUNICATION APPARATUS

CROSS-REFERENCE TO RELATED APPLICATION

This application claims the priority benefit of Taiwan application serial no. 96127760, filed on Jul. 30, 2007. The entirety of the above-mentioned patent application is hereby incorporated by reference herein and made a part of this specification.

BACKGROUND OF THE INVENTION

1. Field of the Invention

The present invention generally relates to a wireless communication apparatus, and more particularly, to a wireless communication apparatus utilizing a fastener to receive/transmit signals.

2. Description of Related Art

The people of the modern society are being used to wireless communication means for conveying information and ideas, and accordingly, the usage efficiency of a wireless communication apparatus gets higher and higher and more diverse for various circumstances. The modem wireless communication apparatus includes, for example, handset, smart handset, multimedia player, PDA (personal digital assistant), aviation GPS (global positioning system), and the like. In addition, various compact wireless communication apparatuses have been gradually developed to become electronic products serving the daily necessities of people.

Generally speaking, the manner for a wireless communication apparatus to receive and process signals usually takes such a mode that an antenna is used to receive signals, then the signals received by the antenna is sent to a circuit for conducting a series of processing. For example, FIG. 1 is a 3D-diagram with localized view of a conventional wireless communication apparatus, wherein a conventional wireless communication apparatus 100 includes a lower housing 110, a substrate 120, a screw 130, an antenna 140, an impedance-matching circuit 150 and a transceiver 160. The antenna 140, the impedance-matching circuit 150 and the transceiver 160 are disposed on the substrate 120.

The conventional wireless communication apparatus 100 has a through hole 121 at a corner of the substrate 120, the lower housing 110 has a nut 111 corresponding to the through hole 121, and the screw 130 is suitable to be screwed into the through hole 121 and fixed in the nut 111 for fastening the substrate 120 with the lower housing 110. Note that the miniaturization design consideration of the conventional wireless communication apparatus 100 requires the screw 130 to be disposed at a corner of the substrate 120. In addition, in order to avoid the antenna 140 from being influence by hand holding effect, the antenna 140 may be disposed at the surrounding edges of the substrate 120 as well.

When both the antenna 140 and the screw 130 are disposed at a corner of the substrate 120 however, the capacity of receiving and transmitting electromagnetic signals of the antenna 140 is affected by the screw 130. Therefore, in order to promote the receiving and transmitting capacity of the antenna 140, the antenna 140 must be spaced apart by a specific distance (for example, 1 mm) or beyond the screw 130. In other words, the conventional wireless communication apparatus 100 needs to pay a cost of larger hardware space for promoting the receiving and transmitting capacity thereof.

SUMMARY OF THE INVENTION

Accordingly, the present invention is directed to a wireless communication apparatus utilizing the body element of an antenna to fix a substrate and housings so as to make the hardware of the wireless communication apparatus more compact.

The present invention provides a wireless communication apparatus, which includes a housing, a substrate and an antenna. The substrate and the antenna are disposed in the housing, a first through hole is disposed at an edge of the substrate and the antenna includes a body element. In terms of the overall operation of the wireless communication apparatus, the antenna utilizes the body element for receiving/transmitting an electromagnetic signal for the wireless communication apparatus to conduct a series of processing on the received electromagnetic signal.

In terms of the structure of the wireless communication apparatus, the first through hole passes through the body element of the antenna so as to fix the substrate in the housing where the above-mentioned antenna not only receives/transmits an electromagnetic signal, but also functions to fix the substrate.

In an embodiment of the present invention, the above-mentioned antenna further includes an extension element disposed on the substrate and coupled with the body element of the antenna, so that the antenna further utilizes the extension element thereof to receive/transmit an electromagnetic signal. Note that the body element and the extension element is comprised of a metal material, including for example but not limited to aluminum, steel, stainless steel, iron, copper, phosphor bronze, beryllium bronze, and the like; and the surface of the metal may be plated with a metal, such as nickel, zinc, and the like.

In an embodiment of the present invention, the above-mentioned housing includes a fastener, an upper housing and a lower housing, wherein the upper housing and the lower housing superpose each other to form a chamber to accommodate the substrate and the antenna, and the fastener is disposed in a chamber formed by the upper housing and the lower housing and is fixed in the lower housing. In addition, the upper housing has a second through hole corresponding to the first through hole, and the fastener is located corresponding to the first through hole. In this way, the body element of the antenna passes through the first through hole and the second through hole and is fastened to the fastener.

Note that when the material of the above-mentioned fastener is comprised of a metal, the antenna may further utilize the fastener to receive/transmit an electromagnetic signal. In addition, in an embodiment of the present invention, the fastener may be a nut or a screwing die.

The present invention also provides a wireless communication apparatus, which includes a housing, a substrate and an antenna. The substrate and the antenna are disposed in the housing, and the antenna includes a body element. In terms of the overall operation of the wireless communication apparatus, the antenna utilizes the body element for receiving/transmitting an electromagnetic signal.

Besides, in terms of the structure of the wireless communication apparatus, the body element of the antenna has a cavity for a corresponding side edge of the substrate to insert into. Since the body element of the antenna is fixed in the housing, thus, the substrate may be fixed in the housing through the antenna. In other words, the above-mentioned antenna not only receives/transmits an electromagnetic signal, but also functions to fix the substrate.

In an embodiment of the present invention, the above-mentioned body element includes a first component and a second component, wherein the first component is for forming a cavity associated with the side edge form of the substrate, while the second component is for connecting the first component and fixed in the housing.

Since the present invention employs an antenna that has the function of fixing the substrate, the wireless communication apparatus can be more compact, and therefore the cost can be reduced and the goal of device miniaturization can be achieved.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
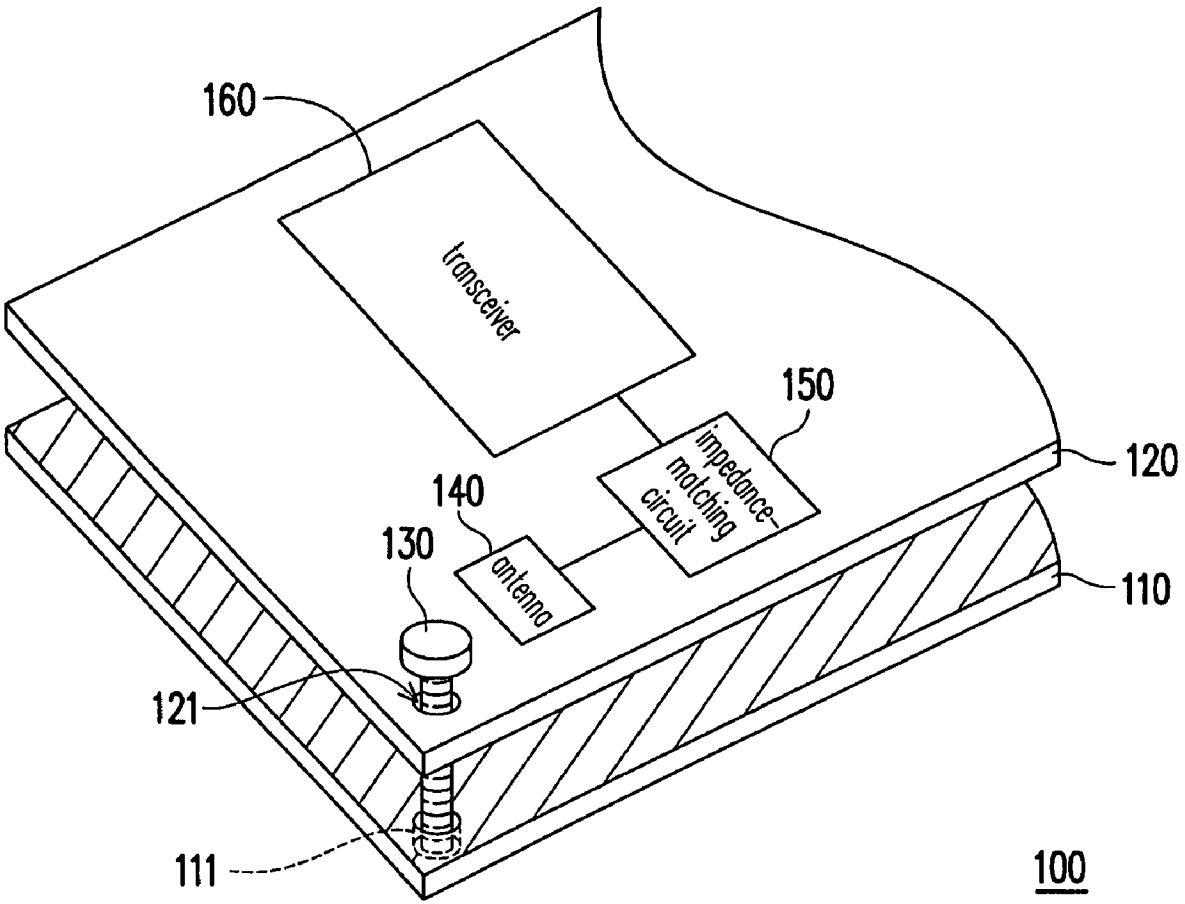
FIG. 1 (PRIOR ART)
FIG. 1 is a 3D-diagram with localized view of a conventional wireless communication apparatus.

Reference will now be made in detail to the present preferred embodiments of the invention, examples of which are illustrated in the accompanying drawings. Wherever possible, the same reference numbers are used in the drawings and the description to refer to the same or like parts.

The major feature of the present invention is the antenna in the wireless communication apparatus, which is employed for receiving/transmitting an electromagnetic signal and also fix the housing and the substrate. In the following, the depicted embodiments together with the included drawings are exemplarily intended to describe, not to limit, the present invention. Anyone skilled in the art is allowed to modify the following embodiments without departing from the scope or spirit of the invention, which still falls within the scope of the following claims and their equivalents.

Prior to explaining the present invention by embodiments, the expansible wireless communication apparatus listed by the following embodiments may be handset, smart handset, multimedia player, PDA (personal digital assistant), aviation GPS (global positioning system), and the like, which are not limited by the present invention.

Figure 2:
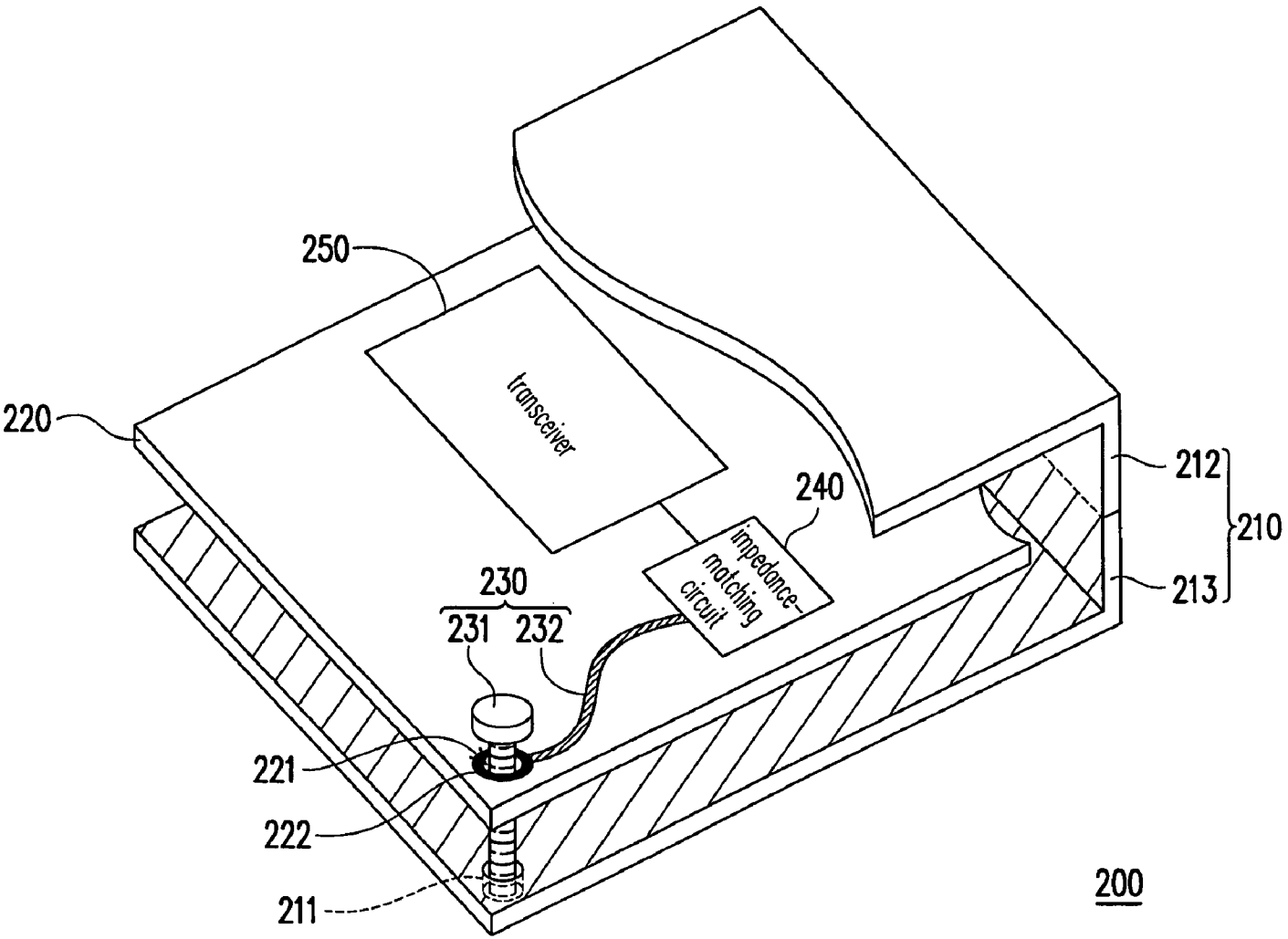
FIG. 2 is a structure diagram of a wireless communication apparatus according to an embodiment of the present invention.

FIG. 2 is a structure diagram of a wireless communication apparatus according to an embodiment of the present invention. Referring to FIG. 2, a wireless communication apparatus 200 includes a housing 210, a substrate 220, an antenna 230, an impedance-matching circuit 240 and a transceiver 250, wherein the antenna 230 includes a body element 231, a through hole 221 is disposed at the edge of the substrate 220, the substrate 220 and the antenna 230 are disposed in the housing 210, and the impedance-matching circuit 240 and the transceiver 250 are disposed on the substrate 220.

In terms of the overall operation of the wireless communication apparatus 200, the antenna 230 utilizes the body element 231 to receive/transmit an electromagnetic signal. Since the impedance-matching circuit 240 is coupled to the transceiver 250 and the antenna 230, the electromagnetic signal received/transmitted by the antenna 230 would travel between the transceiver 250 and the antenna 230 via the impedance-matching circuit 240, wherein the impedance-matching circuit 240 makes the impedance of the antenna 230 to match with that of the transceiver 250, therefore, the energy loss during the travelling of the electromagnetic signal between the transceiver 250 and the antenna 230 is reduced. The transceiver 250 receives an electromagnetic signal in associated with the antenna 230 and then a series of processing is conducted on the received electromagnetic signal.

In order to avoid the antenna 230 from being influenced by hand holding effect, the antenna 230 is required to be disposed at an edge of the substrate 220. Meanwhile, the through hole 221 is also disposed at the same edge of the substrate 220 at a same position as the antenna 230. However, so-called edge of the substrate 220 includes a corner of the substrate 220 as well, thus as shown by FIG. 2, the through hole 221 of the present embodiment is disposed at a corner of the substrate 220 corresponding to the position of the antenna 230.

In terms of the structure of the wireless communication apparatus 200, the body element 231 of the antenna 230 would pass through the through hole 221 and be fixed in the housing 210 to fix the substrate 220 in the housing 210. In other words, the antenna 230 of the embodiment not only receives/transmits an electromagnetic signal, but also functions to fix the substrate 220. Compared to the prior art, the wireless communication apparatus 200 can be more compact, and therefore the cost can be reduced and the goal of the miniaturization can be achieved.

In more detail, the antenna 230 further includes an extension element 232 and the substrate 220 further has a metal film 222, wherein the extension element 232 is disposed on the substrate 220, the metal film 222 covers the surface of the through hole 221 and is coupled to the extension element 232 and the body element 231. The extension element 232 is coupled to the body element 231 through the metal film 222. Thus, the antenna 230 is able to further utilize the extension element 232 for receiving/transmitting an electromagnetic signal.

It would be understood by those skilled in the art that once the extension element 232 and the body element 231 are coupled to each other, the antenna 230 is able to utilize the extension element 232 for receiving/transmitting an electromagnetic signal. Therefore, although the embodiment explains an implementation of the couplings between the extension element 232 and the body element 231, but it is not intended to limit the scope of the present invention to the above-mentioned coupling means between the extension element 232 and the body element 231 as such.

In addition, the body element 231 and the extension element 232 of the embodiment are comprised of metal, including for example but not limited to aluminum, steel, stainless steel, iron, copper, phosphor bronze, beryllium bronze, and the like; and the surface of the metal may be plated with a metal, such as nickel, zinc, and the like. Furthermore, the body element 231 of the embodiment may be comprised of a screw, while the extension element 232 may be comprised of a metal wire, wherein the frequency range of the electromagnetic signal received and transmitted by the antenna 230 may be adjusted by changing the length of the screw length or the metal wire.

Continuing to refer FIG. 2, the housing 210 in the embodiment includes a fastener 211, an upper housing 212 and a lower housing 213, wherein the upper housing 212 and the lower housing 213 superpose each other to form a chamber to accommodate the substrate 220 and the antenna 230. In addition, the fastener 211 is disposed in a chamber formed by the upper housing 212 and the lower housing 213, and the fastener 211 is fixed in the lower housing 213 at a location corresponding to the location of the through hole 221 so as to enable the body element 231 to be fastened to the fastener 211.

Figure 3:
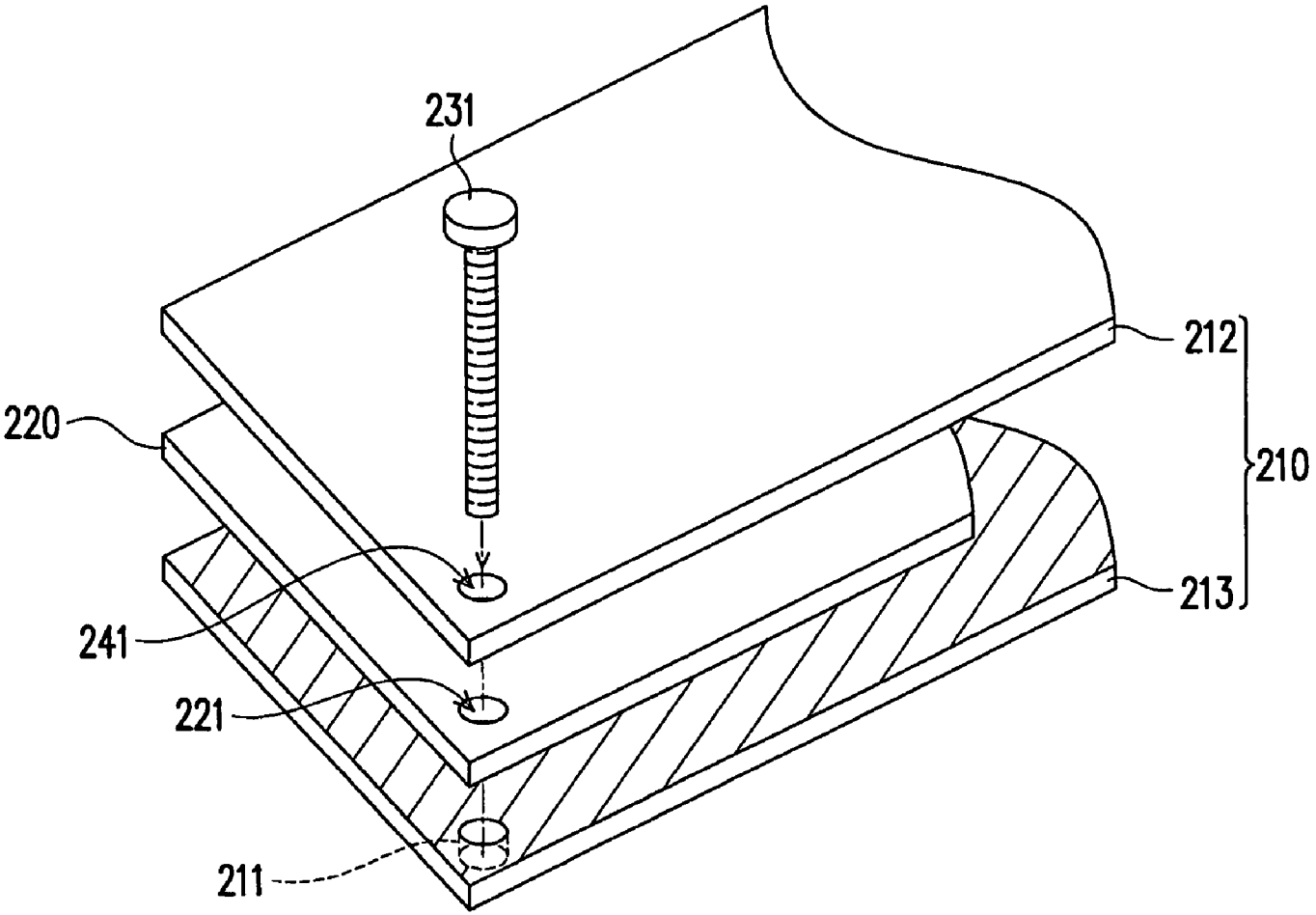
FIG. 3 is an exploded diagram of a housing and a substrate according to an embodiment of the present invention.

Although the embodiment provides a fastening implementation to enable the substrate 220 to be fixed in the housing 210 through the body element 231, however those skilled in the art would understand that various methods for fastening the body element 231 and the fastener 211 may also be utilized to achieve the purpose of fixing the substrate 220 is fixed in the housing 210 by using the body element 231 of the antenna 230, which shall also be considered to fall within the scope of the present invention. For example, FIG. 3 is an exploded diagram of a housing and a substrate according to an embodiment of the present invention. Referring to FIG. 3, when the upper housing 212 has a through hole 241 corresponding to the fastener 211, the body element 231 is able to pass through the through hole 241 to be fastened to the fastener 211. In other words, the body element 231 simultaneously passes through the through holes 241 and 221 to be fixed in the fastener 211, which enables the substrate 220 to be more firmly fixed in the housing 210.

Since the body element 231 is fastened to the fastener 211, which means the body element 231 and the fastener 211 are coupled to each other. Thus, when the fastener 211 is comprised of a metal material, the antenna 230 is able to further utilize the fastener 211 for receiving/transmitting an electromagnetic signal. Note that the fastener 211 of the embodiment may be a nut or a screwing die.

Figure 4:
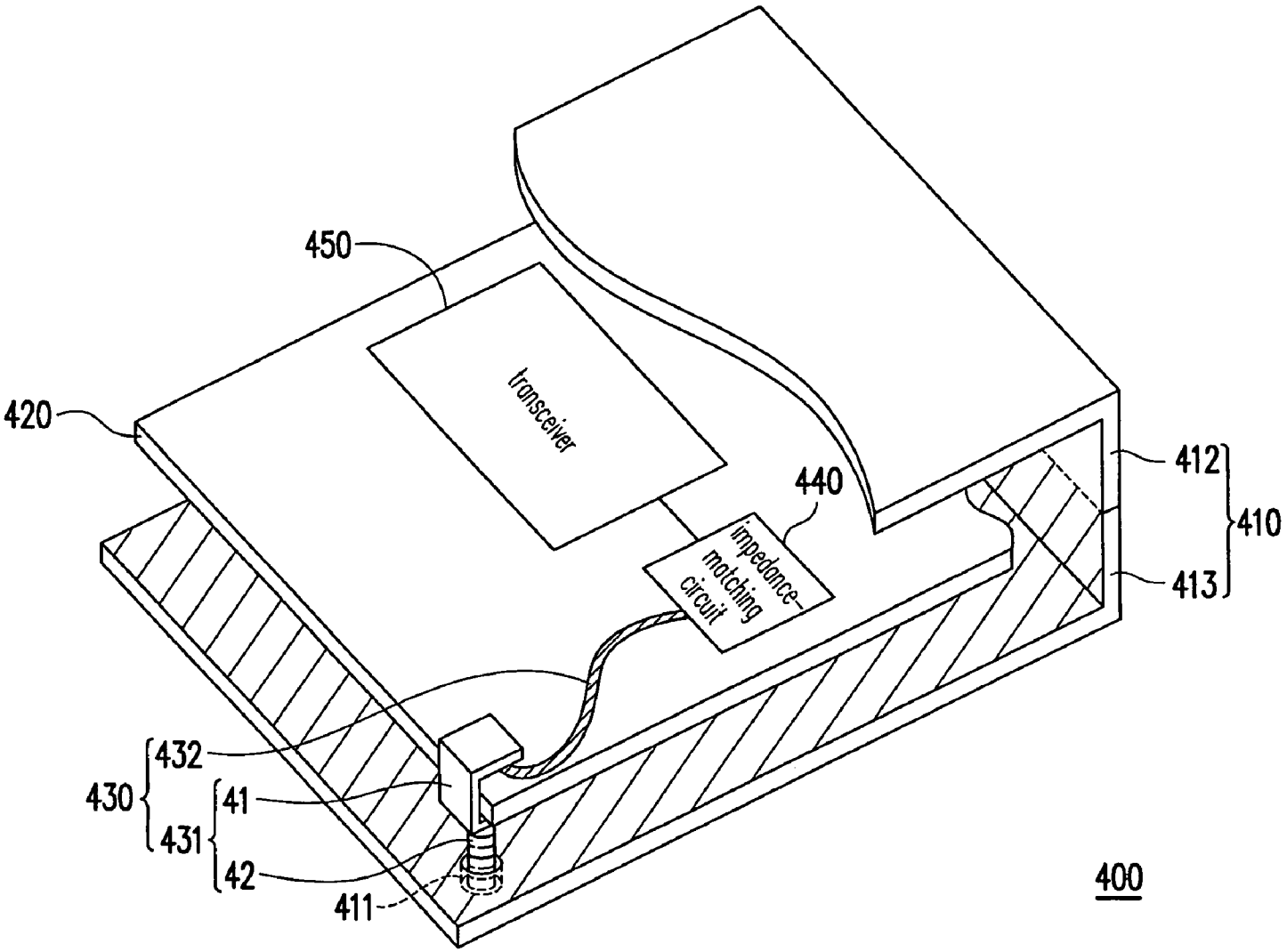
FIG. 4 is a structure diagram of a wireless communication apparatus according to another embodiment of the present invention.

FIG. 4 is a structural diagram of a wireless communication apparatus according to another embodiment of the present invention. Referring to FIG. 4, a wireless communication apparatus 400 includes a housing 410, a substrate 420, an antenna 430, an impedance-matching circuit 440 and a transceiver 450, wherein the substrate 420 and the antenna 430 are disposed in the housing 410, and the impedance-matching circuit 440 and the transceiver 450 are disposed on the substrate 420.

The operation of the embodiment is similar to that of FIG. 2 that the antenna 430 is for receiving/transmitting an electromagnetic signal, the impedance-matching circuit 440 is for reducing the energy loss during delivering the electromagnetic signal so as to make the transceiver 450 associated with the antenna 430 to receive a complete electromagnetic signal; in turn, the transceiver 450 also transmit a complete electromagnetic signal to the antenna 430 through the impedance-matching circuit 440.

The major difference between the embodiment and that of FIG. 2 rests in that although the antenna 430 provided by the embodiment functions to fix the substrate 420 as well, but with a different fixing method from that of FIG. 2. For example, referring to FIG. 4, the antenna 430 includes a body element 431 and an extension element 432, and the body element 431 includes a first component 41 and a second component 42, wherein the first component 41 has a cavity fitting the side edge form of the substrate 420, so that the side edge of the substrate 420 is able to be inserted into the first component 41. On the other hand, since the second component 42 connects the first component 41 and is fixed in the housing 410, the substrate 420 is able to be fixed in the housing 410 through the antenna 430.

Note that the extension element 432 is disposed on the substrate 420 and connected to the first component 41, therefore, the antenna 430 is able to simultaneously utilize the body element 431 and the extension element 432 for receiving/transmitting an electromagnetic signal. In the embodiment, the housing 410 includes a fastener 411, an upper housing 412 and a lower housing 413, wherein the upper housing 412 and the lower housing 413 superpose each other to form a chamber to accommodate the substrate 420 and the antenna 430, while the fastener 411 is fixed in the lower housing 413 at a location corresponding to the location of the second component 42 so as to make the second component 42 fastened to the fastener 411.

In addition, the body element 431 and the extension element 432 of the embodiment are comprised of a metal material, and the second component 42 is comprised of aluminum, steel, stainless steel, iron, copper, phosphor bronze, beryllium bronze, and the like; and the surface of the metal may be plated with metal, such as nickel, zinc, and the like. On the other hand, the second component 42 of the embodiment may be a screw, while the extension element 432 may be a metal wire, and the fastener 411 may be a nut or a screwing die. As to other details of the embodiment are covered by the above-mentioned embodiments, and omitted to describe herein.

In summary, the wireless communication apparatus of the present invention utilizes an antenna for receiving/transmitting an electromagnetic signal, and also utilizes the antenna to fix the substrate and the housing so that the wireless communication apparatus can be rendered more compact compared to the prior art.

The above described are preferred embodiments of the present invention only, which do not limit the implementation scope of the present invention. It will be apparent to those skilled in the art that various modifications and equivalent variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A wireless communication apparatus, comprising:

a housing;

a substrate, disposed in the housing, comprising a first through hole at a edge thereof, and an antenna, disposed in the housing, comprising:

a body element, for passing through the first through hole and being fastened to the housing, wherein the antenna utilizes the body element to receive/transmit an electromagnetic signal.

2. The wireless communication apparatus according to claim 1, wherein the antenna further comprises an extension element disposed on the substrate and coupled to the body element so that the antenna utilizes the extension element for receiving/transmitting the electromagnetic signal.

3. The wireless communication apparatus according to claim 2, wherein the surface of the through hole is covered by a metal film and coupled to the extension element and the body element.

4. The wireless communication apparatus according to claim 2, wherein the extension element is comprised of a metal material.

5. The wireless communication apparatus according to claim 1, wherein the body element comprises a screw comprised of a metal material.

6. The wireless communication apparatus according to claim 5, wherein a surface of the metal material is plated with a metal including nickel or zinc.

7. The wireless communication apparatus according to claim 1, wherein the housing comprises a fastener located at a position corresponding to the first through hole so as to make the body element fastened to the fastener.

8. The wireless communication apparatus according to claim 7, wherein the housing further comprises:

an upper housing, having a second through hole corresponding to the first through hole, wherein the body element passes through the second through hole; and a lower housing, superposing the upper housing to form a chamber to accommodate the substrate and the antenna, wherein the fastener is disposed in the chamber and fastened to the lower housing.

9. The wireless communication apparatus according to claim 7, wherein the fastener is comprised of a metal material and the antenna further utilizes the fastener to receive/transmit the electromagnetic signal.

10. The wireless communication apparatus according to claim 7, wherein the fastener comprises a nut or a screwing die.

11. The wireless communication apparatus according to claim 1, further comprising:

a transceiver, disposed on the substrate for receiving/transmit the electromagnetic signal in association with the antenna; and an impedance-matching circuit, disposed on the substrate and coupled to the transceiver and the antenna so as to make the impedance of the antenna match with that of the transceiver.

12. The wireless communication apparatus according to claim 1, wherein the edge of the substrate comprises a corner of the substrate.

* * * * *